United States Patent [19]

Harrison et al.

[11] Patent Number: 4,844,246

[45] Date of Patent: Jul. 4, 1989

[54] KIT FOR PREPARING BLISTER PACKAGES

[75] Inventors: John A. Harrison, Hudson, Wis.; Gary A. Isakson, Woodbury, Minn.; James R. Nelson, Hudson, Wis.

[73] Assignee: Minnesota Mining and Manufacturing Company, St. Paul, Minn.

[21] Appl. No.: 263,054

[22] Filed: Oct. 27, 1988

Related U.S. Application Data

[62] Division of Ser. No. 156,985, Feb. 18, 1988, Pat. No. 4,802,584.

[51] Int. Cl.[4] ..... B65D 69/00

[52] U.S. Cl. ..... 206/223; 206/447; 206/460; 206/461; 206/538; 428/40; 428/178

[58] Field of Search ..... 206/223, 447, 460, 461, 206/528, 538, 820, 558, 526; 428/40, 178

[56] References Cited

U.S. PATENT DOCUMENTS

| | | | |
|---|---|---|---|
| 2,248,317 | 7/1941 | Van Cleef . | |
| 2,979,840 | 4/1961 | Eastman | 206/820 X |
| 3,086,899 | 4/1963 | Smith et al. | 428/178 X |
| 3,195,770 | 7/1965 | Robertson | 206/538 |
| 3,305,077 | 2/1967 | Greif et al. . | |
| 3,503,493 | 3/1970 | Nagy . | |
| 3,665,543 | 5/1972 | Nappi . | |
| 3,924,748 | 12/1975 | Braverman | 206/534.1 |
| 4,015,717 | 4/1977 | Richardson et al. | 206/534 |
| 4,148,273 | 4/1979 | Hollingsworth et al. | 116/325 |
| 4,158,411 | 6/1979 | Hall et al. | 206/531 |
| 4,211,326 | 7/1980 | Hein et al. | 206/461 X |
| 4,211,329 | 7/1980 | Braverman | 206/534 |
| 4,231,477 | 11/1980 | De Felice | 206/532 |
| 4,254,871 | 3/1981 | Poore | 206/534 |
| 4,288,065 | 9/1981 | Braverman . | |
| 4,316,541 | 2/1982 | Braverman et al. | 206/532 |
| 4,416,375 | 11/1983 | Braverman et al. | 206/534.1 |
| 4,526,474 | 7/1985 | Simon | 368/10 |
| 4,534,468 | 8/1985 | Nuckols et al. | 206/534 |
| 4,590,109 | 5/1986 | Holmberg | 428/40 |
| 4,650,706 | 3/1987 | Emmel | 428/40 |
| 4,742,913 | 5/1988 | Emmel et al. | 206/460 |

*Primary Examiner*—Stephen Marcus
*Assistant Examiner*—Bryon Gehman
*Attorney, Agent, or Firm*—Donald M. Sell; Walter N. Kirn; David L. Weinstein

[57] ABSTRACT

Kit for preparing a package for dispensing solid products such as pills, said kit comprising:

(1) at least one blister tray having a single compartment or an array of compartments, and (2) at least one sheet bearing an adhesive on one major surface thereof and having dimensions such that it is capable of covering said single compartment or said array of compartments.

In another aspect of this invention, a plurality of the aforementioned sheets can be aggregated into a pad, from which the sheets can be conveniently dispensed.

4 Claims, 3 Drawing Sheets

KIT FOR PREPARING BLISTER PACKAGES

This is a division of application Ser. No. 156,985, filed Feb. 18, 1988, now U.S. Pat. No. 4,802,584.

BACKGROUND OF THE INVENTION

This invention relates to the field of packages, and in particular, blister packages formed of a blister tray and a sheet bearing an adhesive, which is adhered to said tray so as to cover the compartments therein.

Out-patient health care frequently involves and requires the consumption by the patient of several different solid medications, e.g. pills, capsules, at several different times during a 24-hour period over a period of a week or more. In many situations, such as when the patient is extremely ill or infirm, a nurse or family member arranges the medications in an orderly manner so that the patient will have an indication of the order in which the medications are to be consumed. To aid in this arrangement, the nurse of family member often uses egg cartons, ice cube trays, coffee cups, plastic containers, or the like for storing the medications. Although these means of arranging and storing are useful, they do have several drawbacks. One of the most significant problems is spillage of the contents of the open container by the patient. Another problem is the difficulty of labeling the container to indicate the specific day and time that a specific medication is to be consumed. Accordingly, it would be desirable for the patient to be provided with low-cost packages for storing and dispensing solid medications, which can easily be filled and labelled by a relatively unskilled nurse or family member. The use of blister packages has been considered for this purpose, since the storage compartments therein can be sealed to prevent spillage of the contents. Blister packages are well-known, particularly in the area of packages for storing and dispensing drug doses. Such blister packages are described, for example, in U.S. Pat. Nos. 4,526,474 and 4,534,468. Although these packages are useful, they generally require packaging by means of trained personnel, e.g. a pharmacist, or automated equipment operated by trained personnel.

SUMMARY OF THE INVENTION

In one aspect, this invention involves a kit that can be used to prepare a package that is useful for dispensing solid products, e.g. pills, capsules. The kit comprises (1) at least one blister tray having a single compartment or an array of compartments, and (2) at least one sheet bearing an adhesive on one major surface thereof and having dimensions such that it is capable of covering the entire single compartment or all of said compartments in said array. The sheet can be made of a material that is readily rupturable by pressure from the fingertips. Preferably, the sheet is one of a plurality of sheets dispensable from a pad of sheets.

The kit of this invention is useful for preparing blister packages for dispensing drug dosages, and is particularly useful for out-patient health care.

In a second aspect, this invention involves the aforementioned pad from which adhesive bearing sheets can be dispensed.

In a third aspect, this invention involves a blister tray constructed so that the contents of the tray's compartment or compartments can be removed without the need for rupturing the sheet material.

DETAILED DESCRIPTION

Figure 1:
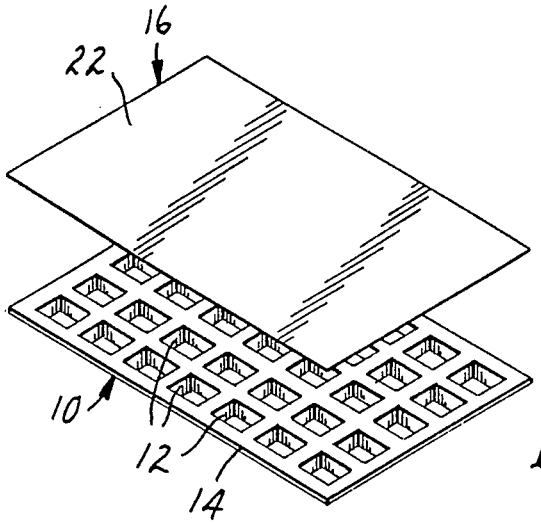
FIG. 1 is a perspective view of a blister tray having a 5×7 array of compartments.

The container for arranging and storing the solid articles is a thermoformed blister tray 10, preferably containing a plurality of compartments 12 formed in and depending from planar sheet material 14, to which the adhesive bearing sheet 16 is bonded, preferably by means of a non-tacky bonding adhesive. Blister trays containing a single compartment can also be used. Thermoformed blister trays 10 are well-known. Representative examples of such trays can be found in U.S. Pat. Nos. 3,305,077 and 4,534,468. If the blister tray 10 is to be used for dispensing pills, capsules, or other solid medications, there should preferably be sufficient compartments 12 to provide for multiple dosages for a period of time equal to or exceeding one day.

The number of storage compartments 12 can vary. For example, a rectangular blister tray 10 having 5×7 array of storage compartments 12 can accommodate five specified daily drug doses and would be useful for a duration of one week. A 10×14 array can accommodate ten specified daily drug doses and would be useful for a duration of two weeks. The blister tray 10 is assembled from a plastic sheet 14 in which are formed at least one compartment 12, and preferably a plurality of compartments. The plastic sheet 14 is preferably made of a thermoformable polymeric material, most preferably of polyvinyl chloride, because polyvinyl chloride is low in cost, is easy to form, and is known to be non-toxic. The plastic sheet may be made of other plastics, such as polyesters, polyacrylates, polymethacrylates, cellulose esters, or thermoplastic polyvinyl materials. If medicaments are packaged, the plastic sheet 14 must be of a material proved to be non-toxic. If tablets for other purposes are used, any plastic material may be used as toxicity is not a problem.

Sheet 16 that bears the adhesive is preferably of such dimensions that it is coextensive with blister tray 10. Sheet 16 adheres to blister tray 10 by means of bonding to the areas of planar sheet material 14 adjacent to and around the perimeter of compartments 12.

It is preferred that several sheets 16 be provided in the form of a pad. A pad 20 suitable for preparing the kit of this invention comprises a plurality of sheets 16, preferably rectangular in shape, each having approximately the same size and shape. Each sheet 16 comprises a backing 22 having coated on one major surface thereof a layer of adhesive 24, preferably a non-tacky bonding adhesive. In the preferred embodiment, the backing 22 comprises a paper/foil composite, with non-tacky bonding adhesive layer 24 being applied to the foil surface. The paper surface is preferably capable of being written upon with an ordinary pen, pencil, or the like. The foil element is generally included to provide air and moisture impermeability. Papers that have been found to be suitable for backing 22 include tissues and bleached Kraft. A foil that has been found to be suitable for the backing 22 is aluminum foil. The adhesive preferably exhibits low tack, so that the contents of storage compartments 12 of blister tray 10 will not adhere thereto. If the adhesive is too tacky, the content of blister compartment 12 will stick to the adhesive. Adhesives that have been found to be useful for this invention are described in U.S. Ser. No. 703,299, filed Feb. 20, 1985, assigned to Minnesota Mining and Manufacturing Company, incorporated herein by reference. Briefly, the adhesive comprises an uncrosslinked copolymer of (a) 10 to 50 weight percent of acrylonitrile and (b) 50 to 90 weight percent of at least one of butadiene and isoprene. The copolymer has a Mooney viscosity (ML-4 at 100° C.) of from 30 to 95, and the adhesive copolymer layer should have a water contact angle of at least 20°, preferably at least 50°. Otherwise it may have inadequate adhesion. When the water contact angle is at least 50°, the tape can be expected to provide a 180° Peelback Value of at least 45 N/dm. Water contact angle and 180° Peelback Value are defined as follows:

Water Contact Angle

Maximum advancing angles for sessile water droplets (2-microliter) on the surface of an adhesive layer are measured by the Zisman method using a NRL contact angle goniometer manufactured by Rame Hart Inc. The droplets are examined on at least six random locations. Angles are measured with a precision of ±2°, and the average values are reported.

180° Peelback Value

Test tapes have as their backing members a composite biaxially oriented film (0.05 mm thick) comprising a layer of poly(ethylene terephthalate) (0.04 mm thick) and an amorphous layer of a copolymer of ethylene terephthalate and ethylene isophthalate (80/20 molar ratio). The adhesive to be tested is coated onto the copolymer surface and dried to a thickness of about 0.01 mm.

To test a tape, a strip of unplasticized polyvinyl chloride (pvc) film (5×12.5 cm) is adhered to a flat panel by an equally large piece of double-coated pressure-sensitive adhesive tape. A 2.5-cm strip of tape to be tested is bonded to the pvc surface under the weight of two passes of a 2-kg hard-rubber roller. After 10 minutes dwell time, a free end of the tape is attached to the scale of an Instron Tensile Tester and pulled from the pvc film at an angle of 180° at a speed of 30 cm/min. The 180° Peelback Value of the tape is the average of two measurements made after peeling has begun.

Other adhesives can also be employed, so long as the contents of the blister compartment do not adhere to the adhesive.

Each sheet 16 has a release liner 26 overlying and in contact with layer of adhesive 24. Release liners that have been found to be suitable for adhesives of the type preferred for this invention can be made of polymeric materials, such as polyethylene and polypropylene.

Each sheet 16 of the tape pad 20 further includes a rectangular strip 28 comprising a backing 30 having a layer of pressure-sensitive adhesive 32 coated on at least a portion of one major surface thereof and a low adhesion backsize layer 34 coated on at least a portion of the other major surface thereof. Pressure-sensitive adhesive layer 32 of strip 28 is adhered to release liner 26 of sheet 16 along one edge thereof and is preferably coextensive with that edge. Typically, the length dimension of strip 28 is coextensive with the width dimension of sheet 16, in order to reduce the cost of making pad 20. Release liner 26 of sheet 16 overlaps a portion of strip 28 and is adhered to adhesive layer 32, typically along the length dimension of strip 28. A pad 20 is formed by adhering a plurality of strips 28 together, so that adhesive layer 32 of a given strip 28 is in face-to-face contact with the low adhesion backsize layer 34 of the next successive strip 28.

A portion of pressure-sensitive adhesive layer 32 is bonded to release liner 26. The remaining portion of pressure-sensitive adhesive layer 32 is bonded to low adhesion backsize layer 34 of backing 30 of the adjacent strip 28 of pad 20.

Kit 40 of this invention comprises at least one blister tray 10 and at least one sheet 16. Preferably, however, kit 40 comprises a plurality of blister trays 10 and a plurality of sheets 16, said sheets being provided in the form of a pad.

Figure 4:
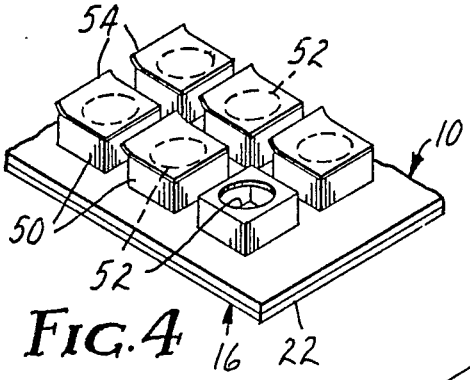
FIG. 4 is a plan view of one embodiment of a compartment of a blister tray wherein the contents thereof are removable without the need for rupturing the sheet material that covers the compartment.
Figure 5:
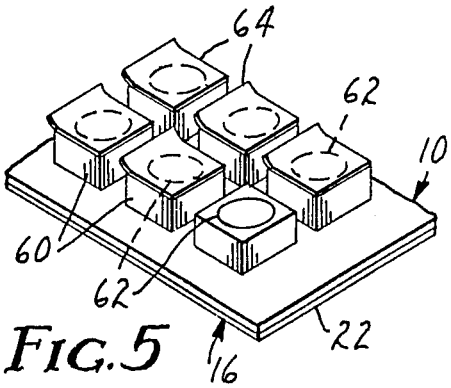
FIG. 5 is a plan view of another embodiment of a compartment of a blister tray wherein the contents thereof are removable without the need for rupturing the sheet material that covers the compartment.
Figure 2:
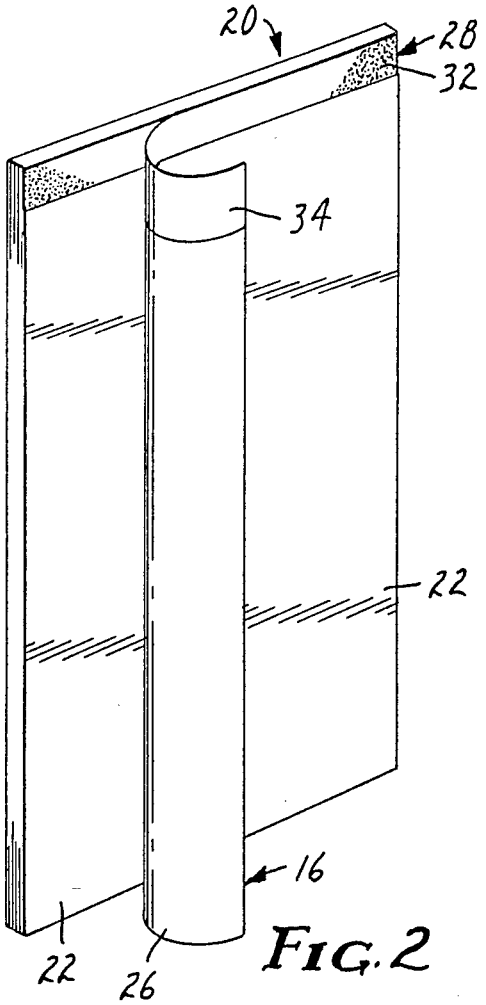
FIG. 2 is a perspective view of a pad of sheets suitable for covering the tray of FIG. 1.
Figure 3:
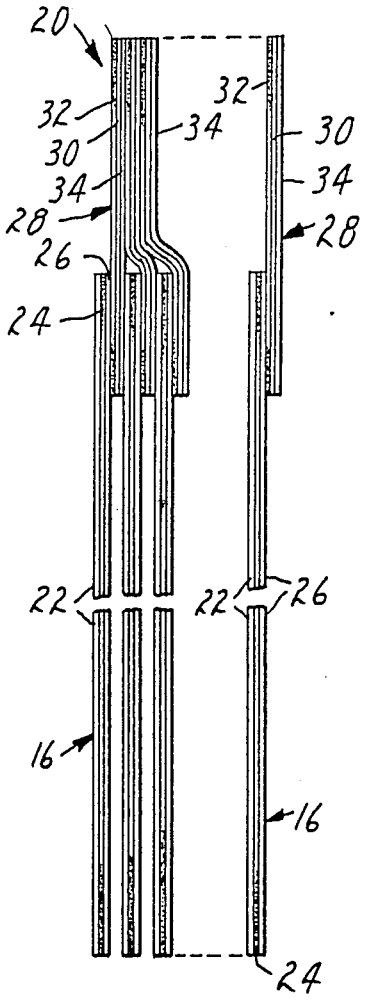
FIG. 3 is a cross-sectional view of a pad of sheets suitable for covering the tray of FIG. 1.

The features of kit 40 of this invention can be varied in order to provide additional desirable characteristics. Blister tray 10 may be formed with a very wide flange, so as to provide a writing surface when sheet 16 is applied thereto. Individual compartments 50 can have a pre-punched hole 52 which can be covered with a tape 54, preferably a tabbed tape (see FIG. 4). The user can remove tape 54 to gain access to the contents of compartment 50 without rupturing sheet 16. Individual compartments 60 can have an area defined by score lines 62 therein, which area can be covered with a tape 64, e.g. a tabbed tape, or, in the alternative, can be left uncovered (see FIG. 5). The user can gain access to the contents of compartment 60 by pushing compartment 60 in the area of score line 62 in order to form a hole in the compartment to gain access to the contents of the compartment without rupturing sheet 16.

OPERATION

To prepare, for example, a week's supply of drug dosages, one can employ the following procedure:

(1) Place the drug dosage in the appropriate 12 in blister tray 10. In FIG. 1, each of the seven columns represents a day of the week. Each of the five rows represents a given time for a given drug dosage.

(2) Remove one sheet 16 from pad 20 by gripping said sheet with one hand, gripping the plurality of remaining sheets with the other hand, and pulling apart at a 180° angle until the sheet to be used separates from the pad.

Figure 6:
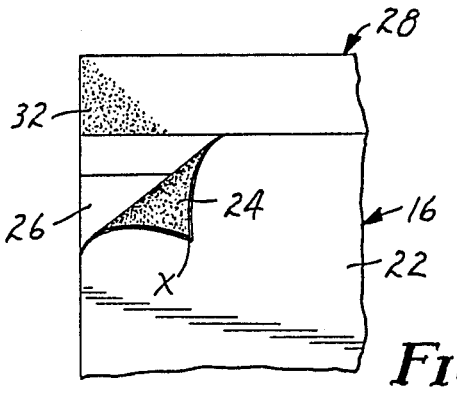
FIG. 6 is a fragmentary view of a portion of a sheet of a pad of this invention during the step of peeling the sheet from the release liner.
Figure 7:
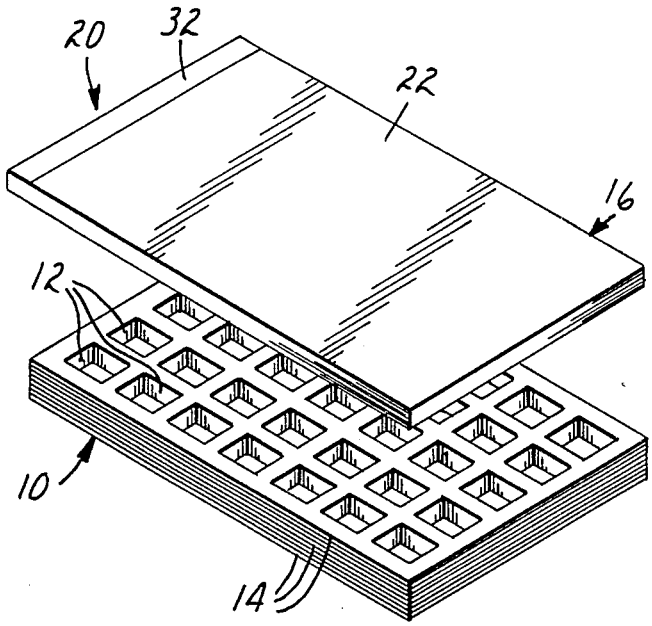
FIG. 7 is a view of the kit combination of a pad of sheets and a plurality of blister trays.

(3) Referring now to FIG. 6, peel sheet 16 away from lin corner X with thumb and forefinger and, while holding strip 28 with other hand, pulling sheet 16 away from release liner 26/strip 28 composite.

(4) Place sheet 16 in register with blister tray 10 and adhere same to tray 10 by means of pressure, attaching said sheet to the planar portions of sheet 14 adjacent to compartments 12. After a few minutes, sheet 16 should be firmly adhered to tray 10. The bond will continue to get stronger over the following 24 hours.

(5) Write the date and the time of given drug dosage on backing 22 of sheet 16 in area overlying or adjacent the particular medication.

At the proper time as noted on the sheet, the patient can merely punch a hole in backing 22 covering compartment 12 or use a tabbed opening to gain access to the drug in order to consume same.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. Kit suitable for preparing a blister package for storing and dispensing solid articles comprising (1) a plurality of blister trays, and (2) a pad comprising a plurality of sheets of similar size and shape, each of said sheets having a backing having on one major surface thereof a layer of a first adhesive, each of said sheets being laminated to a release layer, said first adhesive layer being in face-to-face contact with said release layer, each of said sheets being attached to a like sheet by means of a first bonding strip having a backing having on one major surface thereof a layer of a second adhesive and on the other major surface thereof a layer of a low adhesion backsize, said first bonding strip being coextensive with at least one edge of said sheets, a portion of said second adhesive layer being bonded to a portion of said release layer, the remainder of said second adhesive layer being bonded to a portion of said layer of said low adhesion backsize of a second bonding strip.

2. Kit according to claim 1 wherein the planar dimensions of said blister trays are substantially similar to the planar dimension of the sheets of said pad.

3. Kit according to claim 1 wherein each said blister tray has a single compartment.

4. Kit according to claim 1 wherein each said blister tray has more than one compartment.

* * * * *